US005598094A

United States Patent [19]

Kiehl et al.

[11] Patent Number: 5,598,094

[45] Date of Patent: Jan. 28, 1997

[54] CURRENT MIRROR

[75] Inventors: Oliver Kiehl, München; Rudolf Koch, Oberhaching, both of Germany

[73] Assignee: Siemens Aktiengesellschaft, Munich, Germany

[21] Appl. No.: 301,867

[22] Filed: Sep. 6, 1994

[30] Foreign Application Priority Data

Sep. 3, 1993 [DE] Germany ..... 43 29 866.4

[51] Int. Cl.[6] ..... G05F 3/20

[52] U.S. Cl. ..... 323/315; 323/316; 327/490; 327/427; 327/542

[58] Field of Search ..... 323/313, 314, 323/315, 316; 363/63; 307/496, 500, 262; 327/340, 397, 387, 427, 490, 542–546

[56] References Cited

U.S. PATENT DOCUMENTS

| | | | |
|---|---|---|---|
| 4,544,878 | 10/1985 | Beale et al. | 323/315 |
| 4,618,815 | 10/1986 | Swanson | 323/315 |
| 4,740,743 | 4/1988 | Reisinger et al. | 323/316 |
| 4,857,863 | 8/1989 | Ganger et al. | 330/264 |
| 5,245,273 | 9/1993 | Greaves et al. | 323/313 |
| 5,451,861 | 9/1995 | Giebel | 323/315 |

FOREIGN PATENT DOCUMENTS

| | | |
|---|---|---|
| 0373471 | 6/1990 | European Pat. Off. . |
| 0454250 | 10/1991 | European Pat. Off. . |

OTHER PUBLICATIONS

Book: "Halbleiter–Schaltungstechnik [Semiconductor circuitry]" (Tietze and Schenk), 8th Edition 1986, pp. 363–364.

*Primary Examiner*—Peter S. Wong
*Assistant Examiner*—Aditya Krishnan
*Attorney, Agent, or Firm*—Herbert L. Lerner; Laurence A. Greenberg

[57] ABSTRACT

A current mirror includes first through eighteenth transistors. The load paths of the first and second transistors are in series for carrying an input current to a first supply potential. The control terminals of the first through eighth transistors receive the input current. The load paths of the fourth, third, ninth and tenth transistors are in series between the first and a second supply potential. The third and ninth transistors form a tap being connected to the control terminals of the ninth, tenth, eleventh, twelfth and thirteenth transistors. The load paths of the fifth, sixth, eleventh and fourteenth transistors are in series between the first and second supply potentials. The sixth and eleventh transistors form a tap being connected to the control terminals of the fourteenth through sixteenth transistors. The load paths of the seventeenth, seventh, twelfth and fifteenth transistors are in series between the first and second supply potentials. The seventh and twelfth transistors form a tap being connected to the control terminals of the seventeenth and eighteenth transistors. The load paths of the eighteenth and eighth transistors are in series for tapping a first output current proportional to the input current from the first supply potential. The load paths of the sixteenth and thirteenth transistors are in series for tapping a second output current equal to the first from the second supply potential. The ninth through sixteenth transistors are of one, and the seventeenth, eighteenth and first through eighth transistors being of the other, conduction type.

6 Claims, 1 Drawing Sheet

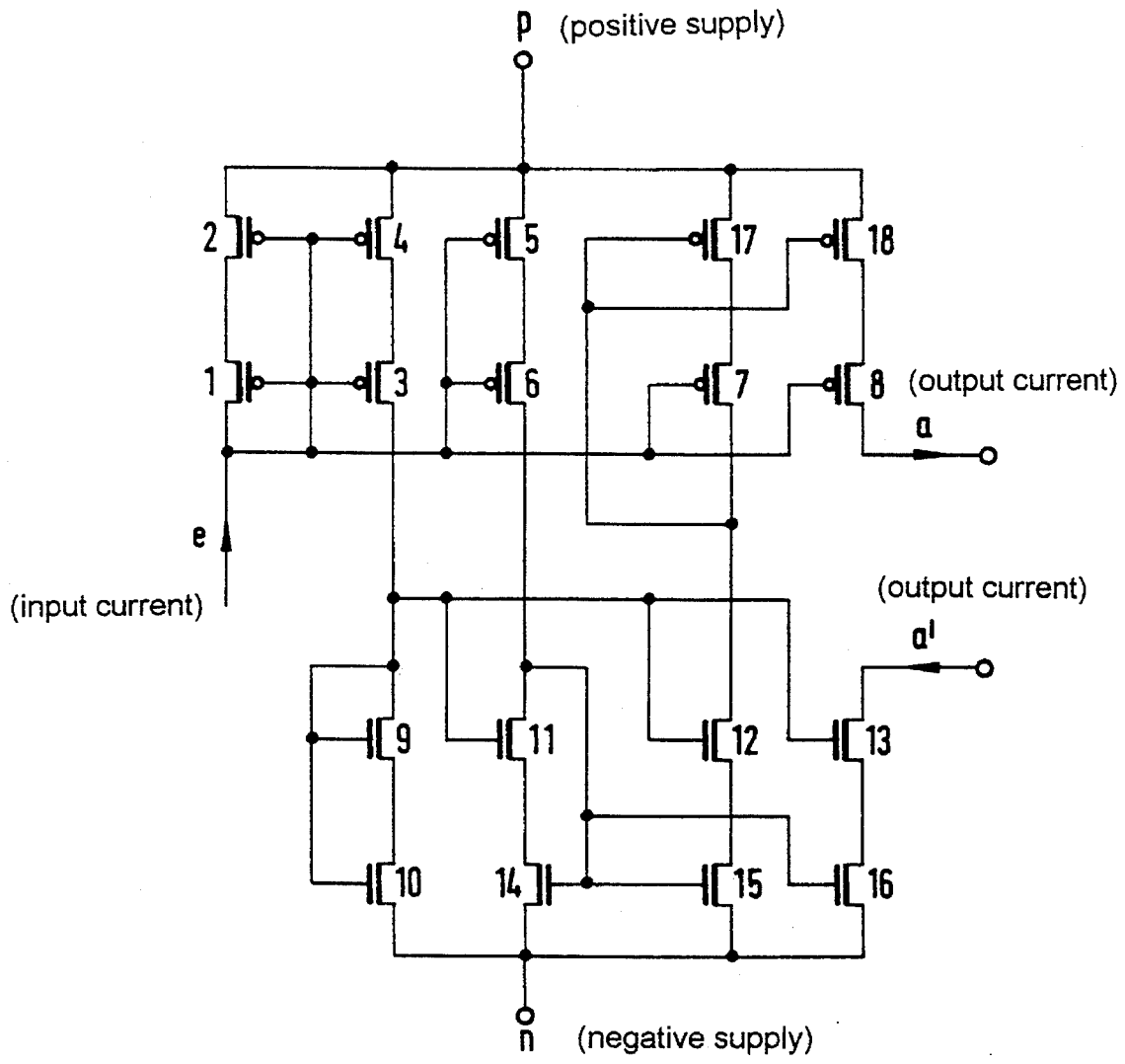
p (positive supply)
2
4
5
17
18
1
3
6
7
8
(output current)
a
e
(input current)
(output current)
a'
9
11
12
13
10
14
15
16
n (negative supply)

CURRENT MIRROR

BACKGROUND OF THE INVENTION

Field of the Invention

The invention relates to a current mirror.

Whenever neither of the two terminals of a consumer to be operated with an impressed current can be allowed to be connected to a fixed potential, so-called "floating current sources" are employed. They are known, for instance, from the book entitled "Halbleiter-Schaltungstechnik" [Semiconductor Circuitry] by U. Tietze and C. Schenk, 8th Edition, 1986, pp. 363–364, and include two grounded current sources that provide opposite currents of equal magnitude and supply the consumer through the respectively other current source. It is essential that both current sources produce currents that are as exactly equal in magnitude as possible. However, that demand is all the harder to meet if the current sources are supposed to be controllable in accordance with a common input variable. That is the case in a current mirror, for instance, which is intended to generate a potential-free output current that is proportional to an input current which does have a potential.

SUMMARY OF THE INVENTION

It is accordingly an object of the invention to provide a current mirror, which overcomes the hereinafore-mentioned disadvantages of the heretofore-known devices of this general type.

With the foregoing and other objects in view there is provided, in accordance with the invention, a current mirror, comprising first through eighteenth transistors having control terminals and load paths; the load paths of the first and second transistors being connected in series for carrying an input current to a first supply potential; the control terminals of the first, second, third, fourth, fifth, sixth, seventh and eighth transistors receiving the input current; the load paths of the fourth, third, ninth and tenth transistors being connected in series between the first supply potential and a second supply potential; the third and ninth transistors having a tap therebetween being connected to the control terminals of the ninth, tenth, eleventh, twelfth and thirteenth transistors; the load paths of the fifth, sixth, eleventh and fourteenth transistors being connected in series between the first and second supply potentials; the sixth and eleventh transistors having a tap therebetween being connected to the control terminals of the fourteenth, fifteenth and sixteenth transistors; the load paths of the seventeenth, seventh, twelfth and fifteenth transistors being connected in series between the first and second supply potentials; the seventh and twelfth transistors having a tap therebetween being connected to the control terminals of the seventeenth and eighteenth transistors; the load paths of the eighteenth and eighth transistors being connected in series for tapping a first output current being proportional to the input current from the first supply potential; the load paths of the sixteenth and thirteenth transistors being connected in series for tapping a second output current of equal magnitude to the first output current from the second supply potential; and the ninth through sixteenth transistors being of one conduction type and the seventeenth, eighteenth and first through eighth transistors being of the other conduction type.

The current mirror according to the invention which has a potential-free output current is distinguished by a high relative accuracy of the individual output currents that have potential and by a very low voltage drop in the input and output branches.

In accordance with another feature of the invention, the transistors are exclusively field-effect transistors, and the ratio between the channel width and the channel length in the second, fourth, fifth and tenth transistors is equal to one-third the ratio between the channel width and the channel length in the seventeenth and eighteenth, fifteenth and sixteenth transistors. This provision assures that the seventeenth and eighteenth transistors, on one hand, and the fourteenth, fifteenth and sixteenth transistors, on the other hand, are operated at the saturation limit, which increases the accuracy and minimizes the voltage drop at these transistors.

In accordance with a further feature of the invention, the second, fourth and fifth transistors are identical; the third and sixth transistors are identical; the seventh and eighth transistors are identical; the twelfth and thirteenth transistors are identical; the fifteenth and sixteenth transistors are identical; and the seventeenth and eighteenth transistors are identical.

In accordance with a concomitant feature of the invention, the second, fourth, fifth, seventeenth and eighteenth transistors; the first, third, sixth, seventh and eighth transistors; the ninth, eleventh, twelfth and thirteenth transistors; and the tenth, fourteenth, fifteenth and sixteenth transistors each have the same channel lengths as one another; and furthermore, the second, fourth and fifth transistors; the fourteenth, fifteenth and sixteenth transistors; the first, third, sixth, seventh and eighth transistors; the seventeenth and eighteenth transistors; and the ninth, eleventh, twelfth and thirteenth transistors each have the same channel widths. As a result, particularly in integrated circuitry, a high degree of synchronism is guaranteed regardless of production-dictated deviations.

Other features which are considered as characteristic for the invention are set forth in the appended claims.

Although the invention is illustrated and described herein as embodied in a current mirror, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE of the drawing is a schematic circuit diagram of an exemplary embodiment of the invention.

DESCRIPTION OF THE PREFERRED EMBODIMENTS

Referring now to the single FIGURE of the drawing in detail, there is seen an exemplary embodiment in which an input current e is applied to gate terminals of a plurality of MOS field-effect transistors of the p-channel type, namely transistors 1–8. Transistors 17 and 18 are also provided. Moreover, the input current e is also delivered to a drain terminal of the transistor 1. Source terminals of the transistors 1, 3, 6, 7, 8 are each connected to a drain terminal of a respective one of the transistors 2, 4, 5, 17 and 18. Source terminals of the transistors 2, 4, 5, 17 and 18 are in turn connected to a positive supply potential p.

A drain terminal of the transistor 3 is connected to gate terminals of a plurality of MOS field-effect transistors of the n-channel type, namely transistors 9–13, and to a drain terminal of the transistor 9. Source terminals of the transistors 9, 11, 12, 13 are each connected to a drain terminal of a respective one of further n-channel MOS field-effect transistors, namely transistors 10, 14, 15, 16. The transistors 10, 14, 15, 16 have source terminals which are in turn connected to a negative supply potential n. Gate terminals of the transistors 14, 15, 16 and a drain terminal of the transistor 11, are coupled to a drain terminal of the transistor 6. Gate terminals of the transistors 17 and 18 are connected to drain terminals of the transistors 7 and 12. Finally, output currents a and a' can be tapped at respective drain terminals of the transistors 8 and 13. The currents a and a' are of equal magnitude in terms of amount and are proportional to the input current e. A so-called "load" is consequently connected between the drain terminals of the transistors 8 and 13.

The transistors 1 through 18 may be referred to as first through eighteenth transistors, respectively.

We claim:

1. A current mirror, comprising:

first through eighteenth transistors having control terminals and load paths;

the load paths of said first and second transistors being connected in series for carrying an input current to a first supply potential;

the control terminals of said first, second, third, fourth, fifth, sixth, seventh and eighth transistors receiving the input current;

the load paths of said fourth, third, ninth and tenth transistors being connected in series between the first supply potential and a second supply potential;

said third and ninth transistors having a tap therebetween being connected to the control terminals of said ninth, tenth, eleventh, twelfth and thirteenth transistors;

the load paths of said fifth, sixth, eleventh and fourteenth transistors being connected in series between the first and second supply potentials;

said sixth and eleventh transistors having a tap therebetween being connected to the control terminals of said fourteenth, fifteenth and sixteenth transistors;

the load paths of said seventeenth, seventh, twelfth and fifteenth transistors being connected in series between the first and second supply potentials;

said seventh and twelfth transistors having a tap therebetween being connected to the control terminals of said seventeenth and eighteenth transistors;

the load paths of said eighteenth and eighth transistors being connected in series for tapping a first output current being proportional to the input current from the first supply potential;

the load paths of said sixteenth and thirteenth transistors being connected in series for tapping a second output current of equal magnitude to the first output current from the second supply potential; and said ninth through sixteenth transistors being of one conduction type and said seventeenth, eighteenth and first through eighth transistors being of the other conduction type.

2. The current mirror according to claim 1, wherein said first through eighteenth transistors are field-effect transistors, and a ratio between a channel width and a channel length in said second, fourth, fifth and tenth transistors is equal to one-third of a ratio between a channel width and a channel length in said seventeenth and eighteenth transistors, and said fourteenth, fifteenth and sixteenth transistors, respectively.

3. The current mirror according to claim 1, wherein said second, fourth and fifth transistors are identical; said third and sixth transistors are identical; said seventh and eighth transistors are identical; said twelfth and thirteenth transistors are identical; said fifteenth and sixteenth transistors are identical; and said seventeenth and eighteenth transistors are identical.

4. The current mirror according to claim 2, wherein said second, fourth and fifth transistors are identical; said third and sixth transistors are identical; said seventh and eighth transistors are identical; said twelfth and thirteenth transistors are identical; said fifteenth and sixteenth transistors are identical; and said seventeenth and eighteenth transistors are identical.

5. The current mirror according to claim 1, wherein:

said second, fourth, fifth, seventeenth and eighteenth transistors have the same channel lengths; said first, third, sixth, seventh and eighth transistors have the same channel lengths; said ninth, eleventh, twelfth and thirteenth transistors have the same channel lengths; and said tenth, fourteenth, fifteenth and sixteenth transistors have the same channel lengths; and said second, fourth and fifth transistors have the same channel widths; said fourteenth, fifteenth and sixteenth transistors have the same channel widths; said first, third, sixth, seventh and eighth transistors have the same channel widths; said seventeenth and eighteenth transistors have the same channel widths; and said ninth, eleventh, twelfth and thirteenth transistors have the same channel widths.

6. The current mirror according to claim 2, wherein:

said second, fourth, fifth, seventeenth and eighteenth transistors have the same channel lengths; said first, third, sixth, seventh and eighth transistors have the same channel lengths; said ninth, eleventh, twelfth and thirteenth transistors have the same channel lengths; and said tenth, fourteenth, fifteenth and sixteenth transistors have the same channel lengths; and said second, fourth and fifth transistors have the same channel widths; said fourteenth, fifteenth and sixteenth transistors have the same channel widths; said first, third, sixth, seventh and eighth transistors have the same channel widths; said seventeenth and eighteenth transistors have the same channel widths; and said ninth, eleventh, twelfth and thirteenth transistors have the same channel widths.

* * * * *